US008902208B2

(12) United States Patent
Chung et al.

(10) Patent No.: US 8,902,208 B2
(45) **Date of Patent: *Dec. 2, 2014**

(54) ORGANIC LIGHT EMITTING DISPLAY DEVICE

(75) Inventors: Bo-Yong Chung, Yongin (KR); Yong-Sung Park, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 1089 days.

This patent is subject to a terminal disclaimer.

(21) Appl. No.: 12/888,285

(22) Filed: Sep. 22, 2010

(65) Prior Publication Data

US 2011/0199357 A1 Aug. 18, 2011

(30) Foreign Application Priority Data

Feb. 17, 2010 (KR) ..... 10-2010-0014111

(51) Int. Cl.
*G09G 5/00* (2006.01)
*G09G 3/32* (2006.01)

(52) U.S. Cl.
CPC ..... *G09G 3/3233* (2013.01); *G09G 2310/0262* (2013.01); *G09G 2300/0861* (2013.01); *G09G 2320/045* (2013.01); *G09G 2300/0819* (2013.01); *G09G 2300/0852* (2013.01); *G09G 2320/043* (2013.01)
USPC ..... 345/211; 345/212; 345/82

(58) Field of Classification Search
USPC ..... 345/211, 212, 76, 82, 85, 206, 204, 87; 326/82, 83; 313/486, 500, 505–507; 327/108–112; 315/169.3
See application file for complete search history.

(56) References Cited

U.S. PATENT DOCUMENTS

2004/0125046 A1 7/2004 Yamazaki et al.
2006/0077138 A1 4/2006 Kim (Continued)

FOREIGN PATENT DOCUMENTS

JP 2002-082651 3/2002
JP 2007-316454 12/2007

(Continued)

OTHER PUBLICATIONS

KIPO Office action dated Jun. 23, 2011 in priority Korean application No. 10-2010-0014111, 1 sht.

(Continued)

*Primary Examiner* — Kent Chang
*Assistant Examiner* — Nelson Rosario
(74) *Attorney, Agent, or Firm* — Christie, Parker & Hale, LLP

(57) ABSTRACT

An organic light emitting display device includes a scan driver, a data driver, and pixels. The scan driver is for sequentially supplying, during each horizontal period of a width 1H, a scan signal with a width of at least 2H to scan lines. The scan driver is further for sequentially supplying an emission control signal to emission control lines that are substantially parallel to the scan lines. The data driver supplies data signals to data lines. Each pixel includes an organic light emitting diode (OLED), a pixel circuit having a first transistor for controlling the amount of current supplied to the OLED, and a compensator for controlling the voltage of a gate electrode of the first transistor for compensating a degradation of the OLED. The compensator includes two transistors and a capacitor. One transistor is coupled to a scan line, and the other is coupled to an emission control line.

17 Claims, 8 Drawing Sheets

(56) References Cited

U.S. PATENT DOCUMENTS

| | | | | |
|---|---|---|---|---|
| 2006/0145964 | A1 | 7/2006 | Park et al. | |
| 2008/0111804 | A1 | 5/2008 | Choi et al. | |
| 2009/0027310 | A1* | 1/2009 | Kim | 345/76 |
| 2009/0146987 | A1* | 6/2009 | Kim et al. | 345/212 |
| 2011/0193850 | A1* | 8/2011 | Chung et al. | 345/212 |
| 2011/0199357 | A1 | 8/2011 | Chung et al. | |

FOREIGN PATENT DOCUMENTS

| | | | |
|---|---|---|---|
| JP | 2008-146051 | | 6/2008 |
| KR | 10-2007-0119274 | A | 12/2007 |
| KR | 10-2008-0080754 | | 9/2008 |
| KR | 10-2009-0059384 | A | 6/2009 |

OTHER PUBLICATIONS

KIPO Office action dated Jun. 23, 2011 for Korean Patent application 10-2010-0011905, (1 page).

U.S. Office action dated Sep. 12, 2013, for cross reference U.S. Appl. No. 12/873,153, (17 pages).

U.S. Office action dated Mar. 21, 2014, for cross reference U.S. Appl. No. 12/873,153, (13 pages).

* cited by examiner

ORGANIC LIGHT EMITTING DISPLAY DEVICE

CROSS-REFERENCE TO RELATED APPLICATION

This application claims priority to and the benefit of Korean Patent Application No. 10-2010-0014111, filed in the Korean Intellectual Property Office on Feb. 17, 2010, the entire content of which is incorporated herein by reference.

BACKGROUND

1. Field

Aspects of embodiments according to the present invention relate to an organic light emitting display device.

2. Description of Related Art

Recently, there have been developed various types of flat panel display devices having less weight and volume than that of a comparable cathode ray tube device. The flat panel display devices include liquid crystal display devices, field emission display devices, plasma display panels, organic light emitting display devices, and the like.

Among these flat panel display devices, the organic light emitting display device displays images using organic light emitting diodes (OLEDs) that emit light through recombination of electrons and holes. The organic light emitting display device has a fast response speed and is driven with low power consumption.

An organic light emitting display device has a plurality of pixels arranged in a matrix form at crossing regions of data lines, scan lines, and power lines. Each of the pixels usually includes an organic light emitting diode (OLED), two or more transistors including a driving transistor, and one or more capacitors.

Such an organic light emitting display device has low power consumption. However, in a typical organic light emitting display device, the amount of current that flows to each OLED varies depending on the threshold voltage of the driving transistor included in each pixel. Therefore, images with unequal luminance are displayed. That is, characteristics of the driving transistors vary between pixels depending on factors such as the fabrication process. From a practical standpoint, it is impossible with current fabrication processes to fabricate the organic light emitting display device so that all of the transistors of the organic light emitting display device have the same characteristics. Therefore, the variation in the threshold voltage of the driving transistors occurs.

To solve such a problem, there has been proposed a method of adding a compensation circuit including a plurality of transistors and capacitors to each of the pixels. The compensation circuit included in each of the pixels stores a voltage corresponding to the threshold voltage of the driving transistor. Accordingly, the variation in the threshold voltage of the driving transistor is compensated.

To help remove motion blur, recent methods of driving a driving transistor at a driving frequency of over 120 Hz have been developed. However, when the driving transistor is driven at such a high frequency, the period for storing the threshold voltage of the driving transistor is shortened. Therefore, it is not possible to sufficiently compensate the threshold voltage of the driving transistor.

SUMMARY

An aspect of an embodiment according to the present invention is directed towards an organic light emitting display device capable of sufficiently ensuring a threshold voltage compensation period, even under high frequency driving.

According to an exemplary embodiment of the present invention, an organic light emitting display device is provided. The organic light emitting display device includes a scan driver, a data driver, and pixels. The scan driver is for sequentially supplying, during each horizontal period, a scan signal to scan lines. The horizontal period has a first width 1H. The scan signal has a second width of at least 2H. The scan signal supplied to a previous one of the scan lines partially overlaps with the scan signal supplied to a current one of the scan lines for a period having a third width. The scan driver is further for sequentially supplying an emission control signal to emission control lines. The emission control lines are substantially parallel to the scan lines. The compensator includes two transistors. One of the two transistors is coupled to one of the scan lines. An other of the two transistors is coupled to one of the emission control lines.

The second width may be 3H.

The current one of the scan lines may be an i-th ("i" is a natural number) one of the scan lines. The previous one of the scan lines may be an (i−1)-th one of the scan lines. The third width may be 2H.

The scan driver may be further for supplying the emission control signal to an i-th ("i" is a natural number) one of the emission control lines to overlap with the scan signal supplied to an (i−2)-th one of the scan lines through an (i+3)-th one of the scan lines.

The pixel circuit may include a second transistor, a third transistor, a first capacitor, a fourth transistor, a fifth transistor, a sixth transistor, and a second capacitor. The second transistor is coupled between a first electrode of the first transistor and a first node that is the gate electrode of the first transistor. The second transistor is for turning on when the scan signal is supplied to an i-th one of the scan lines. The third transistor is coupled between one of the data lines and a second node. The third transistor is for turning on when the scan signal is supplied to the (i+3)-th one of the scan lines. The first capacitor is coupled between the first and second nodes. The fourth transistor is coupled between the second node and a reference power source. The fourth transistor is for turning on when the scan signal is supplied to the i-th one of the scan lines. The fifth transistor is coupled between the first electrode of the first transistor and a first power source. The fifth transistor is for turning off when the emission control signal is supplied to the i-th one of the emission control lines. The sixth transistor is coupled between the first node and the first power source. The sixth transistor is for turning on when the scan signal is supplied to the (i−2)-th one of the scan lines. The second capacitor is for storing a voltage corresponding to one of the data signals supplied during a period in which the third transistor is turned on.

The second capacitor may be coupled between an anode electrode of the OLED and the first node.

The second capacitor may be coupled between an anode electrode of the OLED and the second node.

The reference power source may be set to have a voltage that is higher than that of a data signal of a black gray-level and is lower than that of a data signal of a white gray-level.

The two transistors may include seventh and eighth transistors. The seventh and eighth transistors are coupled between a control power source and a third node. The third node is an anode electrode of the OLED. The seventh and eighth transistors are for turning on during different times. The compensator may further include a third capacitor. The third capacitor is for controlling the voltage of the gate electrode of the first transistor based on a variation of a voltage at a fourth node. The fourth node is a common node of the seventh and eighth transistors. A gate electrode of the eighth transistor is coupled to the i-th one of the emission control lines. A gate electrode of the seventh transistor is coupled to any one of the (i−2)-th one of the scan lines through the (i+3)-th one of the scan lines.

The second capacitor may be coupled between the third and first nodes.

The second capacitor may be coupled between the third and second nodes.

The third capacitor may be coupled between the fourth and first nodes.

The third capacitor may be coupled between the fourth and second nodes.

The control power source may be set to have a voltage identical to that of the reference power source.

The control power source may be set to have a lower voltage than that of the reference power source.

The control power source may be set to have a higher voltage than that of the reference power source.

The data driver may be for supplying some of the data signals to the data lines during each horizontal period.

In embodiments of an organic light emitting display device according to the present invention, the threshold voltage of a driving transistor can be compensated during a period of 2H or wider. Accordingly, an image with a desired luminance can be displayed even in fast driving. Further, the degradation of an OLED can be compensated using a compensator. Accordingly, an image with a desired luminance can be displayed regardless of the degradation of the OLED.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
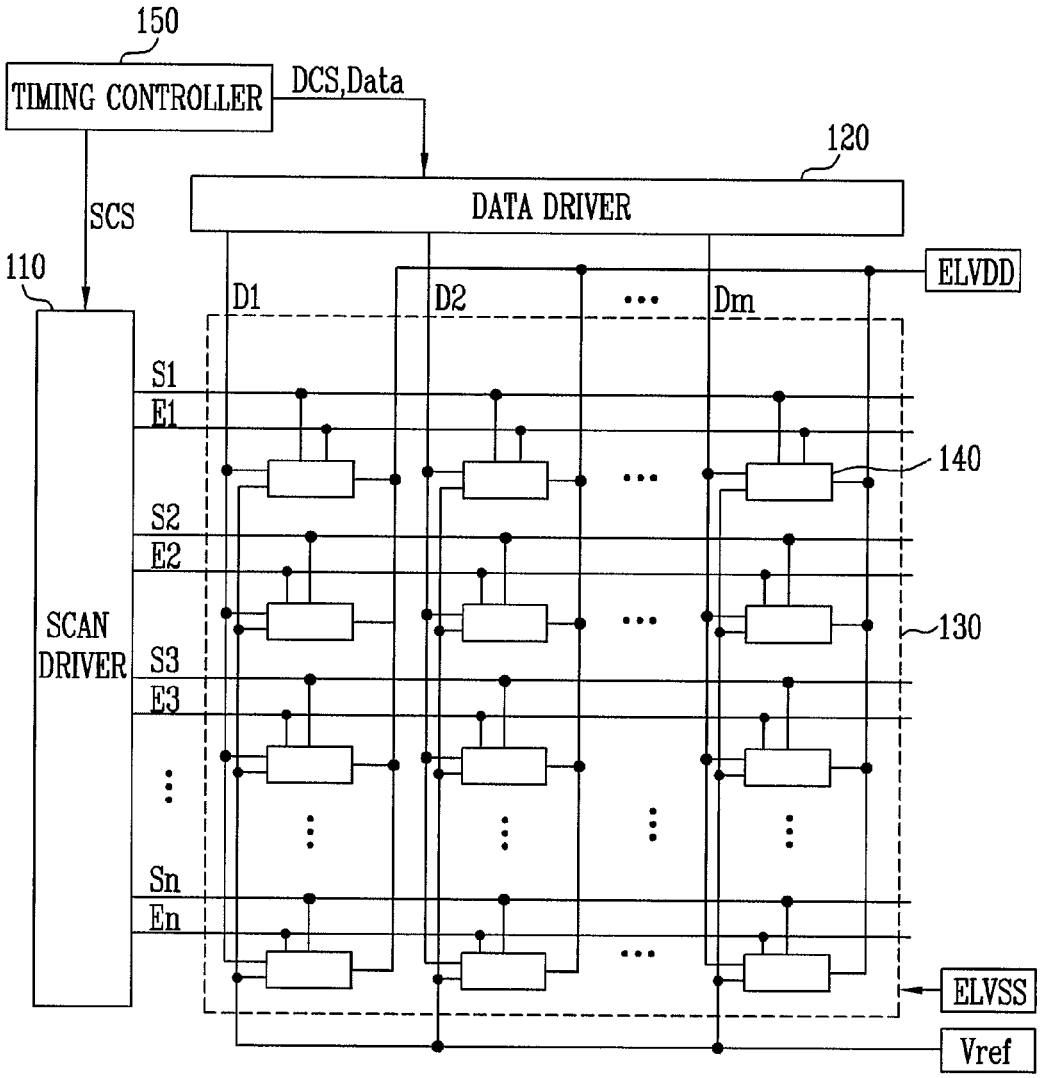
FIG. 1 is a block diagram of an organic light emitting display device according to an embodiment of the present invention.

Hereinafter, certain exemplary embodiments according to the present invention will be described with reference to the accompanying drawings. Here, when a first element is described as being coupled to a second element, the first element may be not only directly coupled (for example, connected) to the second element but may also be indirectly coupled (for example, electrically connected) to the second element via one or more third elements. Further, some of the elements that are not essential to the complete understanding of the exemplary embodiments of the invention are omitted for clarity. In addition, like reference numerals refer to like elements throughout. Finally, reference names for power sources and their corresponding voltages are used interchangeably, with the appropriate meaning apparent from context.

FIG. 1 is a block diagram of an organic light emitting display device according to an embodiment of the present invention.

Referring to FIG. 1, the organic light emitting display device includes a display unit 130 having pixels 140 positioned at crossing regions of data lines D1 to Dm and scan lines S1 to Sn, with emission control lines E1 to En substantially parallel to the scan lines S1 to Sn; a scan driver 110 for driving the scan lines S1 to Sn and the emission control lines E1 to En; a data driver 120 for driving the data lines D1 to Dm; and a timing controller 150 for controlling the scan driver 110 and the data driver 120.

The scan driver 110 receives scan drive control signals SCS supplied from the timing controller 150. The scan driver 110 then generates a scan signal and sequentially supplies the generated scan signal to each of the scan lines S1 to Sn. Here, the scan signal to one scan line overlaps with that supplied to the previous scan line during a partial overlap period. The scan signal has a width of 2H or wider. Here, "H" or "1H" refers to a horizontal period, that is, the period between the starting of supplying the supplying the scan signal to consecutive scan lines. For convenience of illustration, it may be assumed that the scan signal has a width of 3H. Thus, the scan signal supplied to an i-th ("i" is a natural number) scan line overlaps with that supplied to an (i−1)-th scan line for a period of 2H.

Further, the scan driver 110 generates an emission control signal and sequentially supplies the generated emission control signal to the emission control lines E1 to En. Here, the emission control signal supplied to an i-th emission control line Ei, for example, completely overlaps with the scan signal supplied from an (i−2)-th scan line to an (i+3)-th scan line (i.e., six consecutive scan lines). According to an exemplary embodiment, the scan signal may be provided as a signal of a high voltage level, while the emission control signal may be provided as a signal of a low voltage level that is lower than the high voltage level.

The data driver 120 receives a data drive control signals DCS supplied from the timing controller 150. The data driver 120 then supplies data signals to the data lines D1 to Dm when the scan signal is supplied.

The timing controller 150 generates the data drive control signals DCS and the scan drive control signals SCS in response to synchronization signals supplied from the exterior thereof. The timing controller 150 then supplies the data drive control signals DCS to the data driver 120 and the scan drive control signals SCS to the scan driver 110. The timing controller 150 also supplies data Data supplied from the exterior thereof to the data driver 120.

The display unit 130 receives a first power ELVDD, a second power ELVSS, and a reference power Vref, supplied from the exterior thereof, and supplies them to each of the pixels 140, which then generate light corresponding to the data signals. Here, the first power ELVDD is set to have a higher voltage than the second power ELVSS so that a current (for example, a predetermined current) is supplied to an organic light emitting diode (OLED) in each of the pixels 140. The reference power Vref is set to have a voltage that is higher than a data signal of a black gray-level and is lower than a data signal of a white gray-level. A detailed description of the reference power Vref will be described later.

In the exemplary embodiment illustrated in FIG. 1, for convenience of illustration, each of the pixels 140 is shown as being coupled to one scan line. However, in the exemplary embodiment being described, each of the pixels 140 is actually coupled to three scan lines. For example, the pixel 140 positioned on an i-th horizontal line is coupled to an (i−2)-th scan line Si−2, an i-th scan line Si, and an (i+3)-th scan line Si+3.

Figure 2:
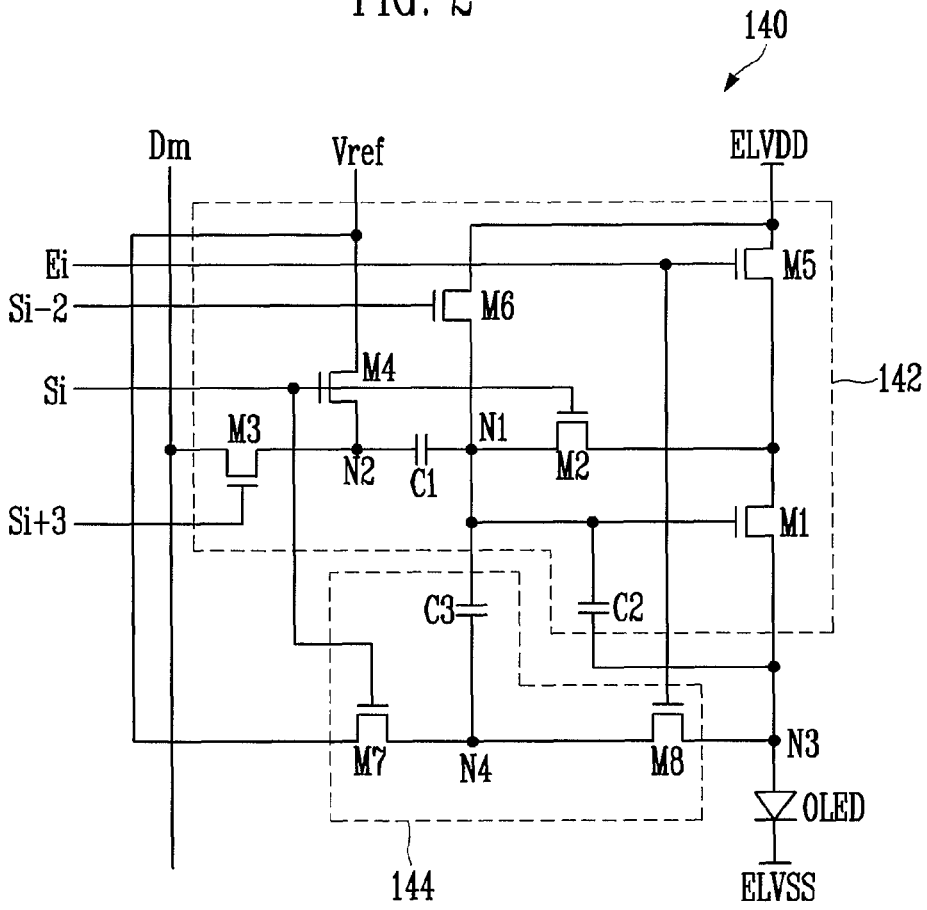
FIG. 2 is a circuit diagram of a pixel according to an embodiment of the present invention.

FIG. 2 is a circuit diagram of a pixel according to an embodiment of the present invention. For convenience of illustration, the pixel 140 that is positioned on an i-th horizontal line (corresponding to an i-th scan line Si and an i-th emission control line Ei) and is coupled to an m-th data line Dm is illustrated in FIG. 2.

Referring to FIG. 2, the pixel 140 includes an organic light emitting diode (OLED); a pixel circuit 142 for controlling the amount of current supplied to the OLED; and a compensator 144 for controlling the voltage at a gate electrode of a driving transistor included in the pixel circuit 142. An anode electrode of the OLED is coupled to the pixel circuit 142, and a cathode electrode of the OLED is coupled to the second power source ELVSS. The OLED generates light with a luminance (for example, a predetermined luminance) corresponding to current supplied from the pixel circuit 142.

The pixel circuit 142 stores a voltage corresponding to the threshold voltage of a first transistor M1 (i.e., the driving transistor) during the period in which a scan signal is supplied to the i-th scan line Si. The pixel circuit 142 stores a voltage corresponding to a data signal when a scan signal is supplied to the (i+3)-th scan line Si+3. The pixel circuit 142 supplies current to the OLED. Here, the current corresponds to the voltage stored after the supply of an emission control signal to the i-th emission control line Ei is stopped. To this end, the pixel circuit 142 includes first to sixth transistors M1 to M6, a first capacitor C1 and a second capacitor C2.

A gate electrode of the first transistor M1 is coupled to a first node N1, and a first electrode of the first transistor M1 is coupled to a second electrode of the fifth transistor M5. A second electrode of the first transistor M1 is coupled to the anode electrode of the OLED (i.e., a third node N3). The first transistor M1 controls the amount of current supplied from the first power source ELVDD to the second power source ELVSS through the OLED, corresponding to the voltage applied to the first node N1.

A gate electrode of the second transistor M2 is coupled to the i-th scan line Si, and a first electrode of the second transistor M2 is coupled to the second electrode of the fifth transistor M5. A second electrode of the second transistor M2 is coupled to the first node N1. When a scan signal is supplied to the i-th scan line Si, the second transistor M2 is turned on to electrically couple the gate electrode and first electrode of the first transistor M1 to each other. In this case, the first transistor M1 is diode-connected.

A gate electrode of the third transistor M3 is coupled to the (i+3)-th scan line Si+3, and a first electrode of the third transistor M3 is coupled to the data line Dm. A second electrode of the third transistor M3 is coupled to a second node N2. When a scan signal is supplied to the (i+3)-th scan line Si+3, the third transistor M3 is turned on to electrically couple the data line Dm and the second node N2 to each other.

A gate electrode of the fourth transistor M4 is coupled to the i-th scan line Si, and a first electrode of the fourth transistor M4 is coupled to the reference power source Vref. A second electrode of the fourth transistor M4 is coupled to the second node N2. When a scan signal is supplied to the i-th scan line Si, the fourth transistor M4 is turned on to supply the voltage of the reference power source Vref to the second node N2.

A gate electrode of the fifth transistor M5 is coupled to the i-th emission control line Ei, and a first electrode of the fifth transistor M5 is coupled to the first power source ELVDD. The second electrode of the fifth transistor M5 is coupled to the first electrode of the first transistor M1. When an emission control signal is supplied to the i-th emission control line Ei, the fifth transistor M5 is turned off, and in other cases, the fifth transistor M5 is turned on.

A gate electrode of the sixth transistor M6 is coupled to the (i−2)-th scan line Si−2, and a first electrode of the sixth transistor M6 is coupled to the first power source ELVDD. A second electrode of the sixth transistor M6 is coupled to the first node N1. When a scan signal is supplied to the (i−2)-th scan line Si−2, the sixth transistor M6 is turned on to supply the voltage of the first power source ELVDD to the first node N1.

The first capacitor C1 is coupled between the first and second nodes N1 and N2. A voltage corresponding to the threshold voltage of the first transistor M1 is stored in the first capacitor C1.

The second capacitor C2 is coupled between the first and third nodes N1 and N3. A voltage corresponding to the data signal is stored in the second capacitor C2.

The compensator 144 controls the voltage at the gate electrode of the first transistor M1 (i.e., the voltage at the first node N1) so that the degradation of the OLED can be compensated. To this end, the compensator 144 includes a seventh transistor M7, an eighth transistor M8, and a third capacitor C3.

A gate electrode of the seventh transistor M7 is coupled to the i-th scan line Si, and a first electrode of the seventh transistor M7 is coupled to the reference power source Vref. A second electrode of the seventh transistor M7 is coupled to a fourth node N4. When a scan signal is supplied to the i-th scan line Si, the seventh transistor M7 is turned on to supply the voltage of the reference power source Vref to the fourth node N4.

A gate electrode of the eighth transistor M8 is coupled to the i-th emission control line Ei, and a first electrode of the eighth transistor M8 is coupled to the third node N3. A second electrode of the eighth transistor M8 is coupled to the fourth node N4. When no emission control signal is supplied to the i-th emission control line Ei, the eighth transistor M8 is turned on to supply the voltage at the third node N3 (i.e., the voltage applied to the anode electrode of the OLED) to the fourth node N4. In operation, the seventh and eighth transistors M7 and M8 are turned on at different times so that the voltage at the fourth node N4 is changed to the voltage of the reference power source Vref or the third node N3.

The third capacitor C3 is coupled between the first and fourth nodes N1 and N4. The third capacitor C3 controls the voltage at the first node N1, corresponding to a change in voltage at the fourth node N4. Here, the voltage at the fourth node N4 is changed corresponding to the degradation of the OLED, and hence, the voltage at the first node N1 is controlled so that the degradation of the OLED is compensated.

Figure 3:
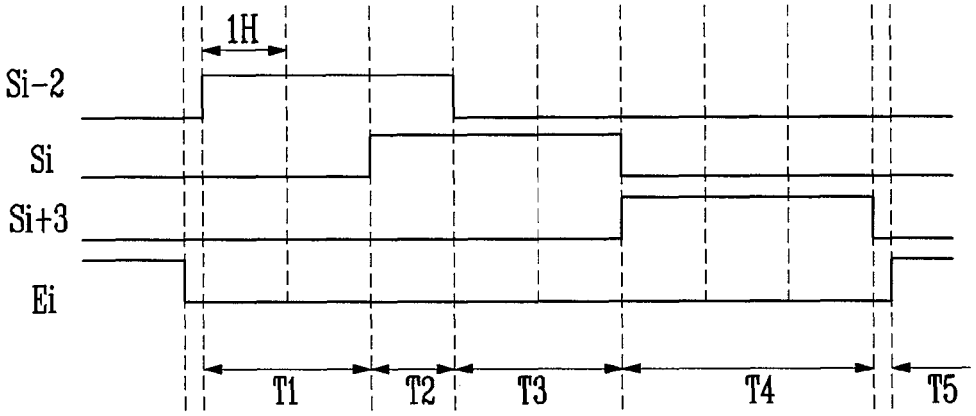
FIG. 3 is a waveform diagram illustrating a driving method of the pixel shown in FIG. 2.

FIG. 3 is a waveform diagram illustrating a driving method of the pixel shown in FIG. 2.

Referring to FIG. 3, an emission control signal is first supplied to the i-th emission control line Ei during first to fourth periods T1 to T4. If the emission control signal is supplied to the i-th emission control line Ei, the fifth and eighth transistors M5 and M8 are turned off.

During the first period T1, a scan signal is supplied to the (i−2)-th scan line Si−2, which turns on the sixth transistor M6, so the voltage of the first power source ELVDD is supplied to the first node N1. The first period T1 is used as an initialization period in which the voltage at the first node N1 is changed into a constant voltage (i.e., the voltage of the first voltage ELVDD).

During the second period T2, a scan signal is supplied to the i-th scan line Si, which turns on the second, fourth, and seventh transistors M2, M4, and M7. When the fourth transistor M4 is turned on, the voltage of the reference power source Vref is supplied to the second node N2. When the second transistor M2 is turned on, the first transistor M1 is diode-connected. When the seventh transistor M7 is turned on, the voltage of the reference power source Vref is supplied to the fourth node N4.

During the third period T3, the supply of the scan signal to the (i−2)-th scan line Si−2 is stopped, which turns off the sixth transistor M6, so the voltage at the first node N1 is set as the voltage obtained by adding the threshold voltage Vth of the first transistor M1 and the threshold voltage Vto of the OLED (i.e., the voltage applied to the third node N3). At this time, the voltage corresponding to the difference of the voltages between the first and second nodes N1 and N2 is stored in the first capacitor C1. That is, the voltage corresponding to the threshold voltage Vth of the first transistor M1 is stored in the first capacitor C1.

Figure 4:
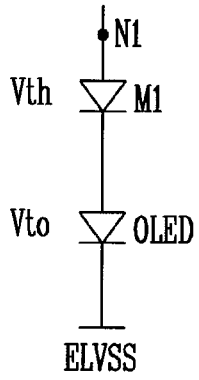
FIG. 4 is a circuit diagram schematically showing a voltage applied to a first node shown in FIG. 2.

More specifically, in the third period T3, when the sixth transistor M6 is turned off, the voltage of the first power source ELVDD is not supplied to the first node N1, while the second transistor M2 maintains a turn-on state. In this case, as illustrated in FIG. 4, the first transistor M1 can be equivalently represented as a diode during the third period T3. Therefore, the voltage at the first node N1 is dropped to the voltage obtained by adding the threshold voltage Vth of the first transistor M1 and the threshold voltage Vto of the OLED.

During the fourth period T4, a scan signal is supplied to the (i+3)-th scan line Si+3, which turns on the third transistor M3, so that a data signal is supplied to the second node N2 from the data line Dm. Here, the third transistor M3 maintains a turn-on state during a period of 3H. Hence, data signals corresponding to an (i−2)-th horizontal line, an (i−1)-th horizontal line, and a current (i-th) horizontal line are sequentially supplied to the second node N2. In this case, the data signal corresponding to the current horizontal line is the final data signal supplied to the second node N2. Accordingly, the third transistor M3 can be stably driven.

When the voltage of the data signal is supplied to the second node N2, the voltage at the second node N2 is changed from the voltage of the reference voltage Vref to the voltage of the data signal. At this time, the voltage at the first node N1, which is set in a floating state, is changed based on the variation of the voltage at the second node N2. Accordingly, the first capacitor C1 maintains the voltage corresponding to the threshold voltage Vth of the first transistor M1.

Figure 5:
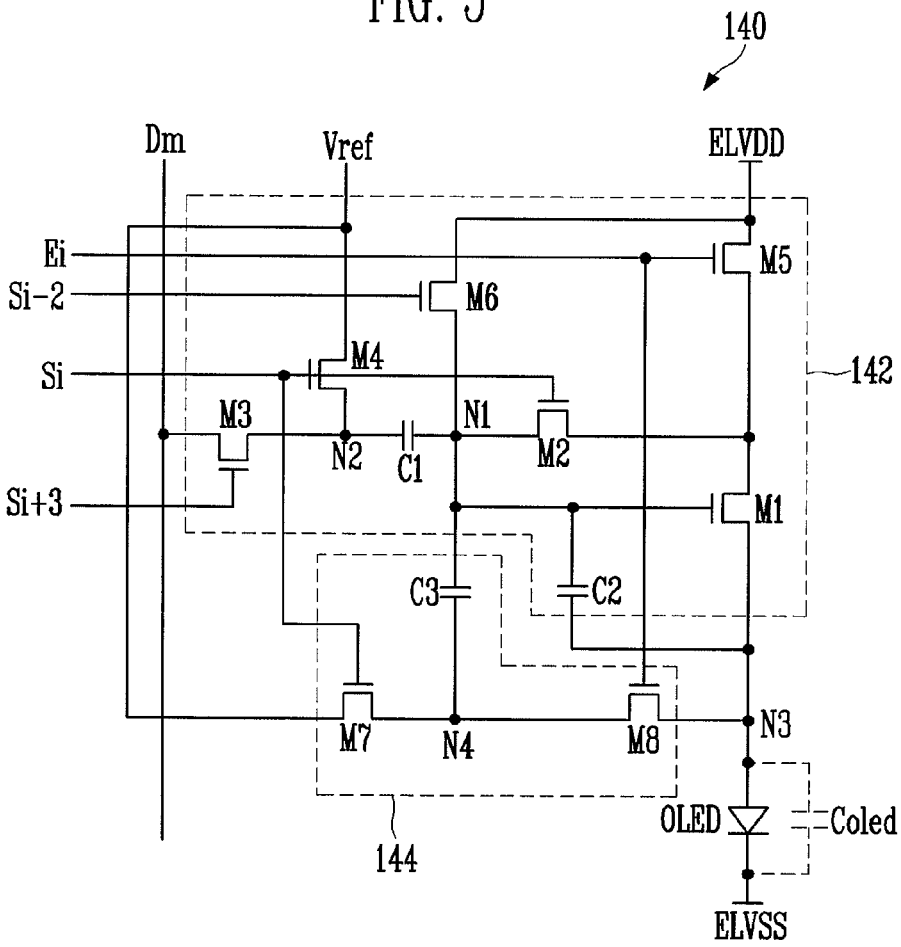
FIG. 5 is a circuit diagram showing a parasitic capacitance component of an OLED shown in FIG. 2.

In addition, the voltage at the third node N3 maintains the threshold voltage Vth of the OLED regardless of the variation of the voltage at the first node N1. Therefore, the voltage corresponding to the data signal is stored in the second capacitor C2 during the fourth period T4. More specifically, a parasitic capacitance component (or parasitic capacitor) Coled is formed at the OLED as shown in FIG. 5. Here, the capacitance of the parasitic capacitor Coled formed at the OLED is set larger than that of the second capacitor C2. Thus, although the voltage at the first node N1 changes, the voltage at the third node N3 barely changes.

Furthermore, the voltage of the reference power source Vref is set as a voltage that is higher than a data signal of a black gray-level and is lower than a data signal of a white gray-level. More specifically, when the data signal corresponding to the white gray-level is supplied, the voltage at the second node N2 is raised to the voltage corresponding to the data signal of the white gray-level. At this time, the voltage at the first node N1 is also raised to the voltage corresponding to the increment of the voltage at the second node N2, and the voltage corresponding to the raised voltage at the first node N1 is stored in the second capacitor C2.

On the other hand, when the data signal corresponding to the black gray-level is supplied, the voltage at the second node N2 is dropped to the voltage corresponding to the data signal of the black gray-level from the voltage of the reference power source Vref. At this time, the voltage at the first node N1 is also dropped corresponding to the decrement of the voltage at the second node N2, and the voltage corresponding to the dropped voltage at the first node N1 is stored in the second capacitor C2. That is, when the black gray-level voltage is supplied, the first transistor M1 is turned off by dropping the voltage at the first node N1. When the white gray-level voltage is supplied, the first transistor M1 is turned on by raising the voltage at the first node N1. The gray levels other than the white gray-level are displayed by controlling the increment of the voltage at the first node N1 using data signals.

The supply of the emission control signal to the i-th emission control line Ei is stopped during a fifth period T5, which turns on the fifth and eighth transistors M5 and M8. When the fifth transistor M5 is turned on, the first electrode of the first transistor M1 and the first power source ELVDD are electrically coupled to each other. At this time, the first transistor M1 supplies current corresponding to the voltage applied to the first node N1 from the first power source ELVDD to the second power source ELVSS through the OLED. Here, the voltage applied to the first node N1 is set as a voltage corresponding to the threshold voltage of the first transistor M1 and the data signal, and accordingly, the current supplied from the first transistor M1 to the OLED is set regardless of the threshold voltage of the first transistor M1. Thus, images with uniform luminance can be displayed.

When the eighth transistor M8 is turned on during the fifth period T5, the voltage at the third node N3 is supplied to the fourth node N4, so that the voltage at the fourth node N4 is changed from the voltage of the reference power source Vref to the voltage at the third node N3. At this time, the voltage at the first node N1 is also changed based on the variation of the voltage at the fourth node N4. Accordingly, the degradation of the OLED can be compensated.

More specifically, the voltage at the third node N3 is increased as the OLED is degraded. In operation, as the OLED is degraded, resistance is increased, and accordingly, the voltage applied to the third node N3 is increased corresponding to the same current. When it is assumed that the voltage of the reference power source Vref is lower than that of the third node N3, the increments of the voltages at the fourth and first nodes N4 and N1 are increased as the OLED is degraded. In this case, as the OLED is degraded, the amount of current supplied to the OLED is increased, and accordingly, the degradation of the OLED can be compensated.

When it is assumed that the voltage of the reference power source Vref is higher than that of the third node N3, the decrements of the voltages at the fourth and first nodes N4 and N1 are decreased as the OLED is degraded. That is, as the OLED is degraded, the voltage at the first node N1 is set to be high corresponding to the same data signal, and accordingly, the degradation of the OLED can be compensated.

In the exemplary embodiment of the present invention illustrated in FIGS. 2-3, the third period T3, in which the threshold voltage of the driving transistor is compensated, is set as a period of 2H. Thus, although the driving transistor is driven at a frequency of 120 Hz or higher, the threshold voltage of the driving transistor can be sufficiently compensated. In addition, it has been illustrated in FIG. 3 that the third period T3 is set as the period of 2H, which corresponds to a supply time of the scan signal of 3H. However, the present invention is not limited thereto. For example, the driving transistor can be controlled so that the threshold voltage of the driving transistor is compensated during a sufficient period by setting the supply time of the scan signal as, for example, a period of 4H or wider.

Figure 6:
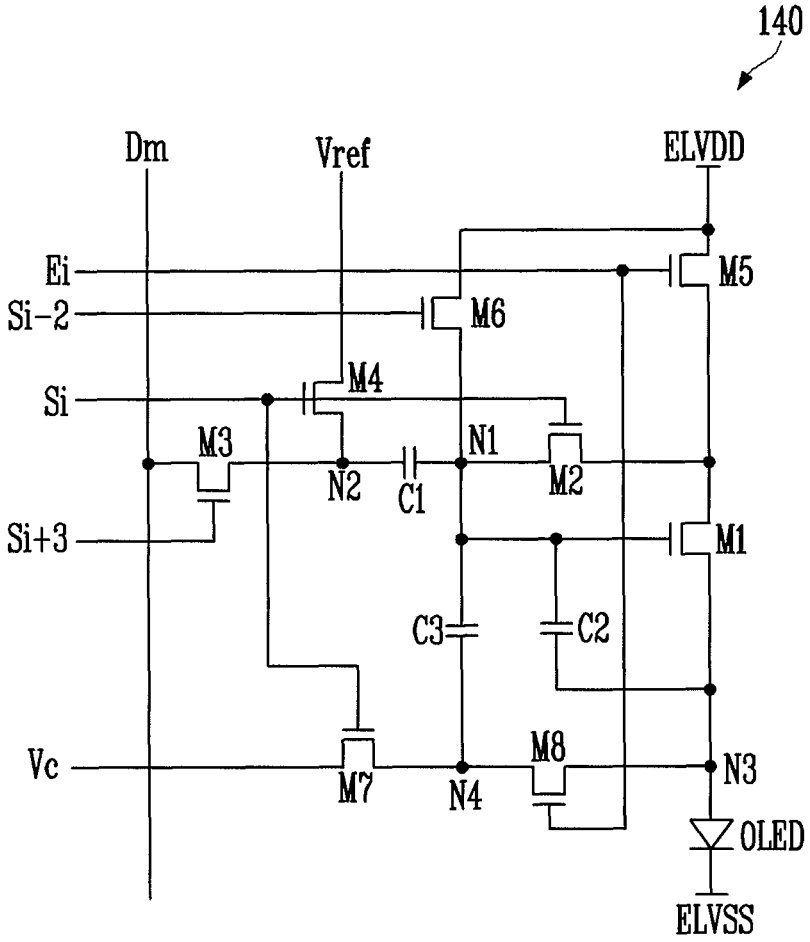
FIG. 6 is a circuit diagram of a pixel according to another embodiment of the present invention.

FIG. 6 is a circuit diagram of a pixel according to another embodiment of the present invention. In FIG. 6, components similar to or identical to those of FIG. 2 are designated by like reference numerals, and their detailed descriptions will not be repeated.

Referring to FIG. 6, in the pixel 140, the first electrode of the seventh transistor M7 is coupled to a control power source Vc that is different from the reference power source Vref. Here, the voltage of the control power source Vc is set higher or lower than that applied to the anode electrode of the organic light emitting diode OLED (i.e., the voltage at the third node N3). For example, the control power source Vc may be set as the first power source ELVDD.

Figure 7:
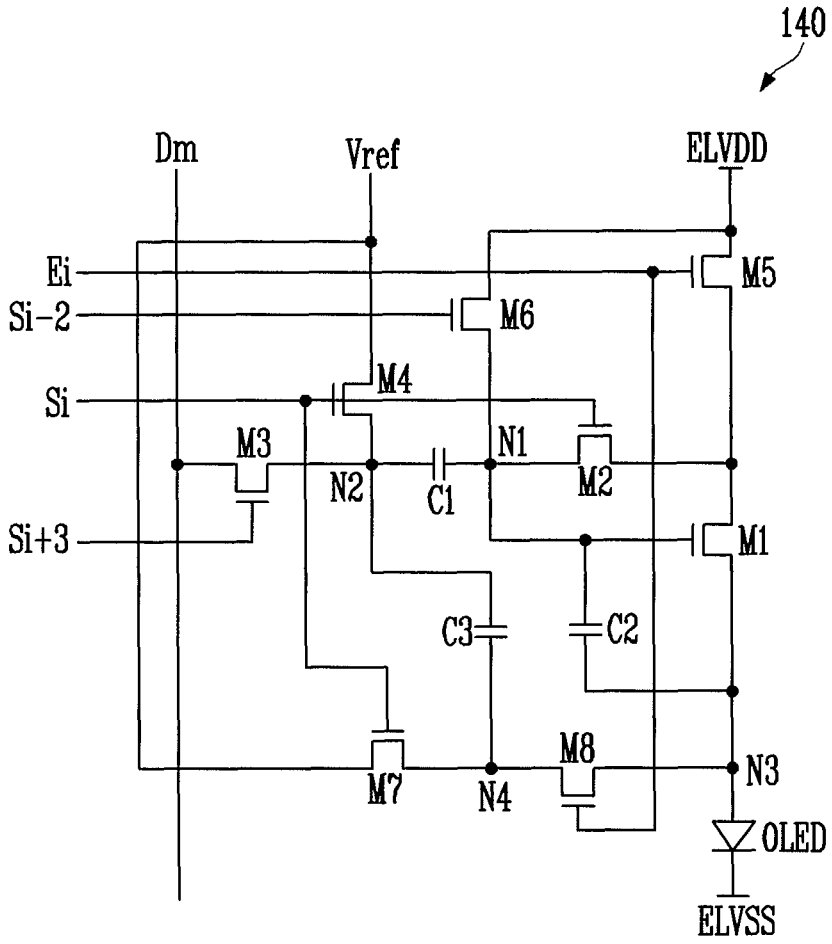
FIG. 7 is a circuit diagram of a pixel according to still another embodiment of the present invention.

FIG. 7 is a circuit diagram of a pixel according to still another embodiment of the present invention. In FIG. 7, components similar to or identical to those of FIG. 2 are designated by like reference numerals, and their detailed descriptions will not be repeated.

Referring to FIG. 7, in the pixel 140, the third capacitor C3 is coupled between the second and fourth nodes N2 and N4. The third capacitor C3 controls the voltage at the second node N2 based on the variation of the voltage at the fourth node N4. Here, the voltage at the first node N1 is changed based on the variation of the voltage at the second node N2, and hence, the voltage at the first node N1 can be stably controlled corresponding to the degradation of the OLED.

Figure 8:
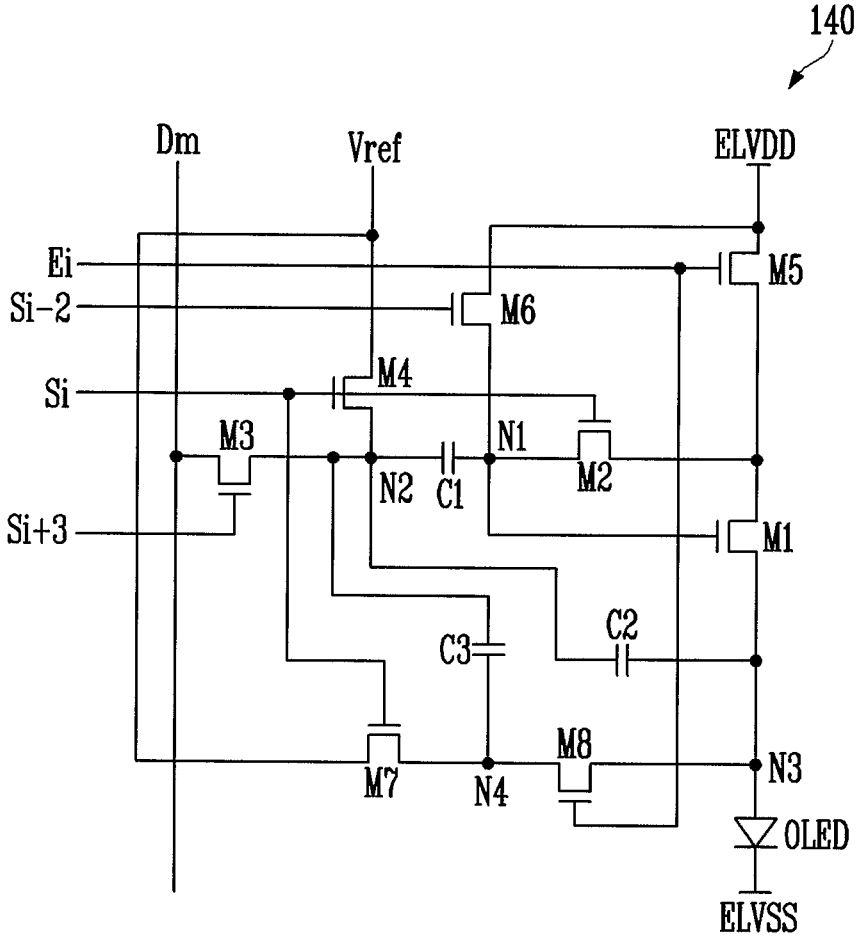
FIG. 8 is a circuit diagram of a pixel according to still another embodiment of the present invention.

FIG. 8 is a circuit diagram of a pixel according to still another embodiment of the present invention. In FIG. 8, components similar to or identical to those of FIG. 2 are designated by like reference numerals, and their detailed descriptions will not be repeated.

Referring to FIG. 8, in the pixel 140, the third capacitor C3 is coupled between the second and fourth nodes N2 and N4, and the second capacitor C2 is coupled between the third and second nodes N3 and N2. The third capacitor C3 controls the voltage at the second node N2 based on the variation of the voltage at the fourth node N4. In this case, the voltage at the second node N2 and, by extension, the voltage at the first node N1 (since the first capacitor C1 is coupled between the second node N2 and the first node N1) are changed based on the variation of the voltage at the fourth node N4, and hence, the degradation of the OLED can be compensated.

The voltage corresponding to the difference of the voltages between the data signals applied to the second node N2 and the third node N3 is stored in the second capacitor C2. The voltage corresponding to the variation of the voltage at the second node N2 is stored in the second capacitor C2, and accordingly, the voltage corresponding to the data signal can be stably stored in the second capacitor C2.

Figure 9:
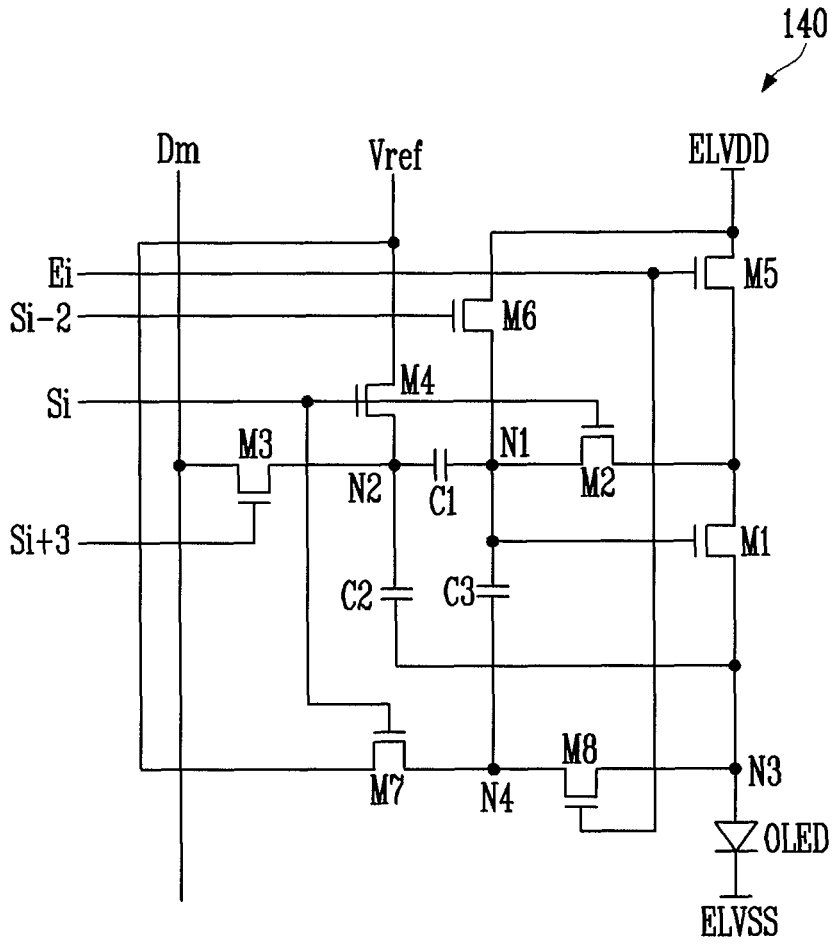
FIG. 9 is a circuit diagram of a pixel according to still another embodiment of the present invention.

FIG. 9 is a circuit diagram of a pixel according to still another embodiment of the present invention. In FIG. 9, components similar to or identical to those of FIG. 2 are designated by like reference numerals, and their detailed descriptions will not be repeated.

Referring to FIG. 9, in the pixel 140, the second capacitor C2 is coupled between the third and second nodes N3 and N2. The voltage corresponding to the difference of the voltages between the data signal applied to the second node N2 and the third node N3 is stored in the second capacitor C2. The voltage corresponding to the variation of the voltage at the second node N2 is stored in the second capacitor C2. Accordingly, the voltage corresponding to the data signal can be stably stored in the second capacitor C2.

Figure 10:
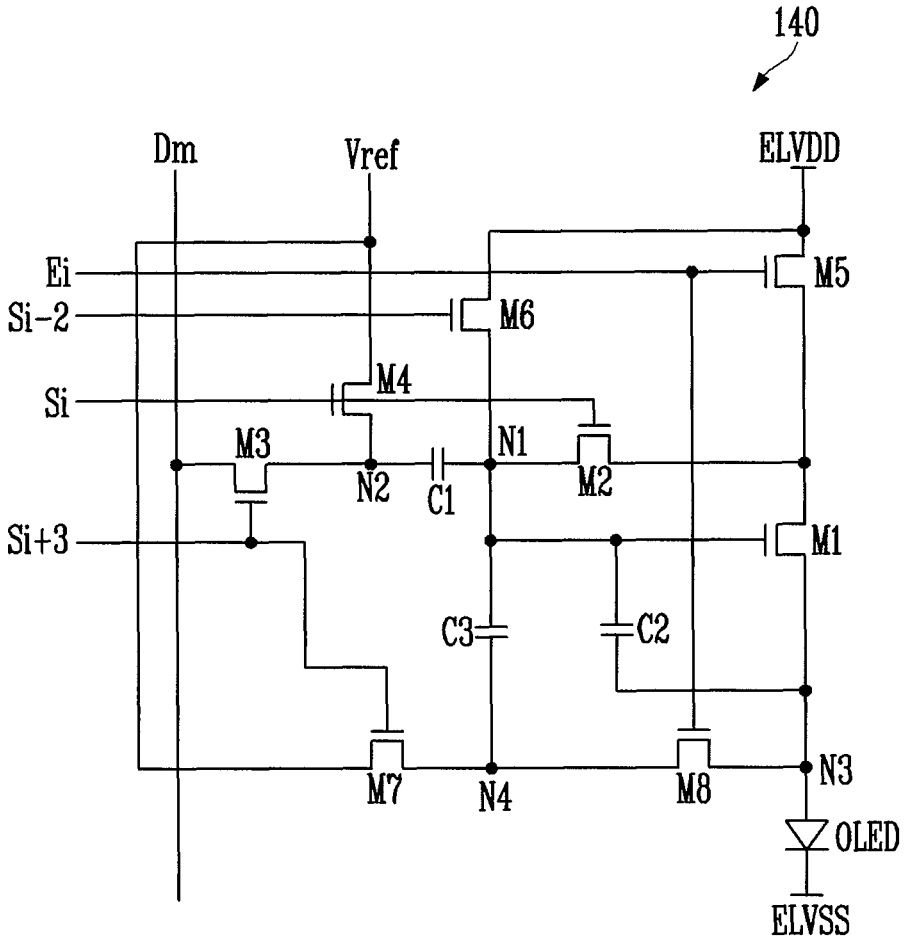
FIG. 10 is a circuit diagram of a pixel according to still another embodiment of the present invention.

FIG. 10 is a circuit diagram of a pixel according to still another embodiment of the present invention. In FIG. 10, components similar to or identical to those of FIG. 2 are designated by like reference numerals, and their detailed descriptions will not be repeated.

Referring to FIG. 10, in the pixel 140, the gate electrode of the seventh transistor M7 is coupled to the (i+3)-th scan line Si+3. When a scan signal is supplied to the (i+3)-th scan line Si+3, the seventh transistor M7 is turned on to change the voltage at the fourth node N4 to the voltage of the reference power source Vref. In operation, in this embodiment, the seventh transistor M7 is first turned on rather than the eighth transistor M8 to change the voltage at the fourth node N4 to the voltage of the reference power source Vref. Thus, the gate electrode of the seventh transistor M7 can be coupled to any one of the (i−2)-th scan line Si−2 to the (i+3)-th scan line Si+3, not just the (i+3)-th scan line Si+3 shown in FIG. 10 or the i-th scan line Si shown in FIGS. 2 and 5-9.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display device comprising:

a scan driver for sequentially supplying, during each horizontal period of a first width 1H, a scan signal with a second width of at least 2H to scan lines so that the scan signal supplied to a previous one of the scan lines partially overlaps with the scan signal supplied to a current one of the scan lines for a period having a third width, the scan driver being further for sequentially supplying an emission control signal to emission control lines substantially parallel to the scan lines;

a data driver for supplying data signals to data lines; and pixels each comprising an organic light emitting diode (OLED), a pixel circuit comprising a first transistor for controlling an amount of current supplied to the OLED, and a compensator for controlling a voltage of a gate electrode of the first transistor for compensating a degradation of the OLED, the compensator comprising two transistors, wherein one of the two transistors is coupled to one of the scan lines, and an other of the two transistors is coupled to one of the emission control lines.

2. The organic light emitting display device according to claim 1, wherein the second width is 3H.

3. The organic light emitting display device according to claim 2, wherein the current one of the scan lines is an i-th ("i" is a natural number) one of the scan lines, the previous one of the scan lines is an (i-1)-th one of the scan lines, and the third width is 2H.

4. The organic light emitting display device according to claim 2, wherein the scan driver is configured to supply the emission control signal to an i-th ("i" is a natural number) one of the emission control lines to overlap with the scan signal supplied to an (i−2)-th one of the scan lines through an (i+3)-th one of the scan lines.

5. The organic light emitting display device according to claim 4, wherein the pixel circuit comprises:

a second transistor coupled between a first electrode of the first transistor and a first node that is the gate electrode of the first transistor, the second transistor for turning on when the scan signal is supplied to an i-th one of the scan lines;

a third transistor coupled between one of the data lines and a second node, the third transistor for turning on when the scan signal is supplied to the (i+3)-th one of the scan lines;

a first capacitor coupled between the first and second nodes;

a fourth transistor coupled between the second node and a reference power source, the fourth transistor for turning on when the scan signal is supplied to the i-th one of the scan lines;

a fifth transistor coupled between the first electrode of the first transistor and a first power source, the fifth transistor for turning off when the emission control signal is supplied to the i-th one of the emission control lines;

a sixth transistor coupled between the first node and the first power source, the sixth transistor for turning on when the scan signal is supplied to the (i−2)-th one of the scan lines; and a second capacitor for storing a voltage corresponding to one of the data signals supplied during a period in which the third transistor is turned on.

6. The organic light emitting display device according to claim 5, wherein the second capacitor is coupled between an anode electrode of the OLED and the first node.

7. The organic light emitting display device according to claim 5, wherein the second capacitor is coupled between an anode electrode of the OLED and the second node.

8. The organic light emitting display device according to claim 5, wherein the reference power source is set to have a voltage that is higher than that of a data signal of a black gray-level and is lower than that of a data signal of a white gray-level.

9. The organic light emitting display device according to claim 5, wherein the two transistors comprise seventh and eighth transistors coupled between a control power source and a third node that is an anode electrode of the OLED, the seventh and eighth transistors for turning on during different times, the compensator further comprises a third capacitor for controlling the voltage of the gate electrode of the first transistor based on a variation of a voltage at a fourth node that is a common node of the seventh and eighth transistors, a gate electrode of the eighth transistor is coupled to the i-th one of the emission control lines, and a gate electrode of the seventh transistor is coupled to any one of the (i−2)-th one of the scan lines through the (i+3)-th one of the scan lines.

10. The organic light emitting display device according to claim 9, wherein the second capacitor is coupled between the third and first nodes.

11. The organic light emitting display device according to claim 9, wherein the second capacitor is coupled between the third and second nodes.

12. The organic light emitting display device according to claim 9, wherein the third capacitor is coupled between the fourth and first nodes.

13. The organic light emitting display device according to claim 9, wherein the third capacitor is coupled between the fourth and second nodes.

14. The organic light emitting display device according to claim 9, wherein the control power source is set to have a voltage identical to that of the reference power source.

15. The organic light emitting display device according to claim 9, wherein the control power source is set to have a lower voltage than that of the reference power source.

16. The organic light emitting display device according to claim 9, wherein the control power source is set to have a higher voltage than that of the reference power source.

17. The organic light emitting display device according to claim 1, wherein the data driver is for supplying some of the data signals to the data lines during each horizontal period.

* * * * *